United States Patent [19]

Kibler et al.

[11] 4,134,373

[45] Jan. 16, 1979

[54] ENGINE SPEED LIMITING CONTROL CIRCUIT

[75] Inventors: Roland G. Kibler, Flushing; Bruce C. Hartfelder, Davison, both of Mich.

[73] Assignee: General Motors Corporation, Detroit, Mich.

[21] Appl. No.: 838,540

[22] Filed: Oct. 3, 1977

[51] Int. Cl.[2] ..... F02D 11/10

[52] U.S. Cl. ..... 123/102; 180/105 E; 361/239

[58] Field of Search ..... 123/102, 108; 180/105 E; 361/239, 236

[56] References Cited

U.S. PATENT DOCUMENTS

| | | | |
|---|---|---|---|
| 3,340,883 | 9/1967 | Peternel | 361/239 |
| 3,568,059 | 3/1971 | Sordello | 361/239 |
| 3,581,720 | 6/1971 | Hemphill | 123/102 |
| 3,695,242 | 10/1972 | Tada et al. | 123/102 |
| 3,715,006 | 2/1973 | Walsh | 180/105 E |
| 3,868,548 | 2/1975 | Grundy | 180/105 E |
| 3,998,191 | 12/1976 | Beyerlein | 123/102 |
| 4,071,109 | 1/1978 | Ezoe | 361/236 |

*Primary Examiner*—Jay P. Lucas
*Attorney, Agent, or Firm*—Warren D. Hill

[57] ABSTRACT

A system for limiting the speed of a gasoline engine includes a circuit responsive to the engine speed which provides control signals to a solenoid valve which in turn controls a vacuum actuator. The vacuum actuator then overrides a manual throttle control to move the throttle toward closed position when a governed engine speed is approached. A control circuit provides a signal having four components; one proportional to engine speed, second and third proportional to engine acceleration and a fourth which is the integrated difference between the engine speed and a preset governed speed. In addition a speed switch actuated when an overspeed condition occurs is effective to inhibit the third component and to increase the fourth component to its maximum value to effect maximum governing action and system stability. The control signal controls a duty cycle oscillator which actuates the solenoid valve.

1 Claim, 2 Drawing Figures

ENGINE SPEED LIMITING CONTROL CIRCUIT

Figure 1:
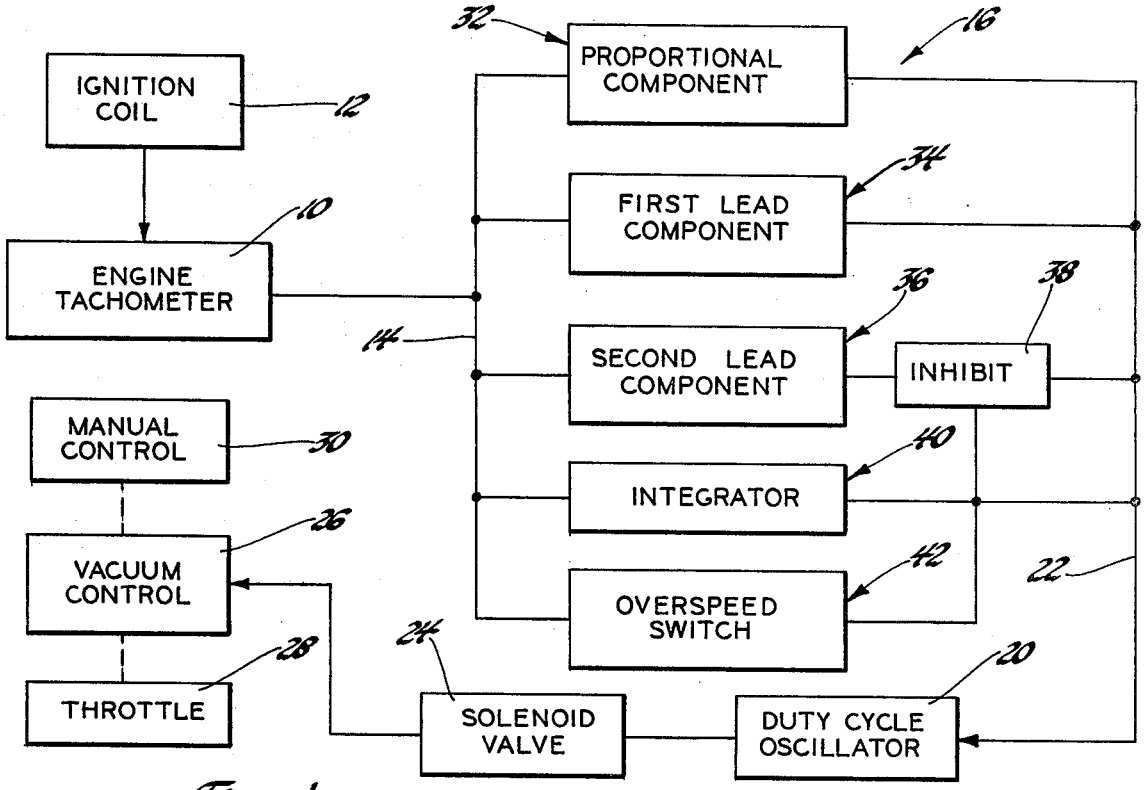

This invention relates to engine speed limiters and particularly to an electrical control circuit for engine speed limiters.

It is common practice to provide governors on truck engines to prevent sustained speeds which are inefficient or harmful to the engine. Normally engine speed increases relatively slowly toward the governed speed during truck operation so that the governing operation is easily carried out. However, there are abnormal situations when very rapid engine acceleration occurs so that the speed limiting control must anticipate an overspeed condition in order to make a correction in time to avoid engine damage. This might occur, for example, when the vehicle transmission is in neutral or the clutch disengaged and the acceleration pedal is depressed to rapidly drive the engine from idle speed to critical speed.

One proposed control circuit for limiting engine speed is disclosed in the U.S. patent to Byerlein et al No. 3,998,191. That circuit was especially useful in conjuction with a particular carburetor which it controlled, however, it is relatively difficult to build and calibrate and its design required a low speed inhibit which prevented it from initiating engine control until relatively high engine speeds were reached.

It is, therefore, a general object of the invention to provide an improved electrical control circuit for an engine speed limiter which has the capability of better controlling overshoot by anticipating overspeed for high acceleration conditions even while the engine speed is low, which circuit is adapted to accurate, fast calibration during manufacture.

The invention is carried out by providing in a system for limiting engine speed a control circuit responsive to engine speed for producing a control signal which has a strong lead term during rapid engine acceleration, and an overspeed switch which forces the control to maximum limiting when overspeed is reached and simultaneously inhibits the strong lead term for improved stability at the governed speed.

Figure 2:
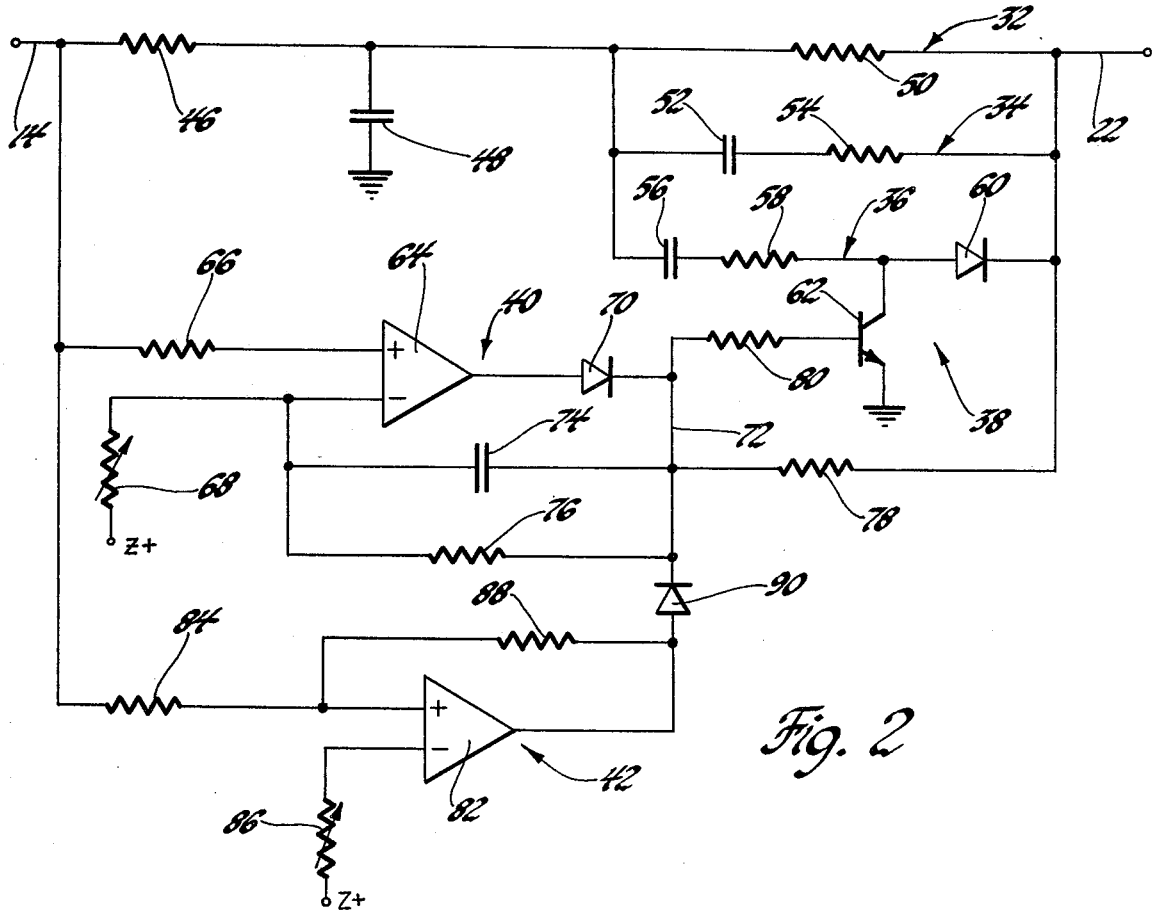

The above and other advantages will be made more apparent from the following specification taken in conjunction with the accompanying drawings wherein like reference numerals referred to like parts and wherein:

FIG. 1 is a block diagram of an engine speed limiting system including a control circuit according to the invention; and FIG. 2 is a schematic electrical diagram of a portion of a control circuit of FIG. 1.

The engine speed limiting system is shown in the block diagram of FIG. 1. An engine tachometer 10 responsive to pulses from the engine ignition coil 12 produces on line 14 a direct voltage proportional to engine speed. The speed signal is then fed to a control circuit which includes a five channel modifying circuit 16 and a duty cycle oscillator 20. The modifying circuit 16 produces a control signal on line 22 which controls the duty cycle of the oscillator 20 as a function of the control signal. The duty cycle will be 0% when no engine speed limiting is required and will increase generally proportionately to the control signal on line 22. The oscillator 20 output controls a solenoid valve 24 which in turn energizes a vacuum actuator 26 which is positioned in a throttle linkage between the throttle 28 and the manual throttle (accelerator pedal) control 30. The overall operation of the system is such that when the engine speed signal on line 14 increases in such a manner that there is a danger of the engine exceeding its governed speed the vacuum actuator will be energized to override the manual control 30 to move the throttle 28 toward its closed position. The degree of throttle closing will be proportional to the duty cycle of the oscillator 20 and hence proportional to the control signal on line 22.

The modifying circuit provides four components of the control signal as a function of engine speed. A proportional component circuit 32 comprises only a resistor which provides a component of the control signal proportional to the engine speed. The first lead component 34 is an RC differentiator which provides a component of the control signal proportional to engine acceleration. The proportional and the first lead components lend smoothness and stability to the system, although at speeds above governed speed, those components are much smaller than the other components described below. The second lead component 36 is another RC differentiator which is scaled to provide a strong lead component during engine acceleration. The strong lead component results in quick response of the throttle control during large accelerations even at low speeds, but tends to induce instability or hunting if applied during steady state governing. The second lead component 36 is in series with an inhibit gate 38 which when activated inhibits the second lead component in order to foster circuit stability at the governed speeds. The inhibit gate 38 is activated whenever the output of an integrator 40 is high enough to effect steady state governing. The integrator 40 integrates that portion of the engine speed signal which exceeds a preset reference value and is effective to supply a strong signal to the line 22 particularly during gradual engine speed increase at high speeds to effect a smooth increase in the control signal 22.

The overspeed switch 42 is triggered when the engine speed exceeds a preset value which is higher than the governed speed and produces a large signal which is fed to the output of the integrator to artificially boost the integrator output to a value sufficient to affect maximum engine governing by forcing the duty cycle oscillator to a 100% duty cycle. The high integrator output effected by the overspeed switch also activates the inhibit gate 38 to inhibit the strong second lead component to improve system stability upon return of the system to a steady state governed condition. When engine speed decreases and the overspeed switch is deactivated, the high signal will gradually decrease due to the integrating action.

Referring to FIG. 2, the line 14 carrying the speed signal is connected to a filter comprising a resistor 46 and a capacitor 48 connected between one end of the resistor 46 and ground. The filter in turn is connected to the three parallel connected circuits which give rise to the proportional and the lead components 32 through 36. The proportional component 32 is supplied by the resistor 50 connected between the resistor 46 and the line 22. The first lead component 34 comprises a capacitor 52 and a resistor 54 serially connected between the resistor 46 and a line 22. The second lead component 36 comprises a capacitor 56 and a resistor 58 connected serially with a diode 60 between the resistor 46 and the line 22. While the components 52 and 54 in the first lead component circuit 34 are selected to provide a moderate signal to lend stability to the system, the capacitor 56 in the second lead component circuit 36 is substantially larger in value than the capacitor 52 so that the second lead component is substantially stronger than the first lead component. A transistor 62 along with the diode 60 comprises the inhibit gate 38. The transistor has its collector connected to the anode of the diode 60 and its emitter connected to ground so that when the transistor 62 is conductive the second lead component is grounded and the diode 60 isolates that ground potential from the line 22.

The integrator 40 comprises an operational amplifier 64 having its positive input terminal connected through an input resistor 66 to the engine speed signal line 14. The negative input terminal of the amplifier 64 is connected through a variable resistor 68 to a source of voltage Z+. The variable resistor 68 is the calibrating resistor used to adjust the reference speed at which the integrator begins to accumulate an output signal. The output of the operational amplifier 64 is connected through a diode 70 to a line 72. The line 72 is connected to the negative input terminal through a feedback integrating capacitor 74 as well as through a resistor 76 in parallel with the capacitor 74. The line 72 comprising the integrator output is connected through a large resistor 78 to the line 22 so that the integrator output contributes to the control signal. The line 72 is also connected through a resistor 80 to the base of the inhibit transistor 62.

The overspeed switch 42 comprises an operational amplifier 82 having its positive input terminal connected through an input resistor 84 to the line 14 and having its negative input terminal connected through an adjustable resistor 86 which is connected to the positive voltage source Z+. The variable resistor 86 allows calibration of the speed at which the overspeed switch 42 will activate. A feedback resistor 88 is connected between the output of the amplifier 82 and the positive input. The amplifier output is connected through a diode 90 to the line 72 at the integrator output.

During normal vehicle operation engine speed will gradually increase to the governed speed and in this case the control signal components provided by the circuits 34 and 36 will be very small because the acceleration is small. The proportional term from the circuit 32 is also relatively small compared to that which will appear from the integrator output. During the gradual acceleration the integrator 40 will begin to produce a positive output as soon as the engine speed exceeds the value corresponding the set point of the calibration resistor 68. Since the integrator output will increase with time, (although modified by the effect of the feedback resistor 76), the integrator output will smoothly reach values sufficient to cause the duty cycle oscillator 20 to begin oscillating at, say, a 10% duty cycle which causes the vacuum actuator to close the throttle 28 a small amount in an effort to diminish the difference between the engine speed and the reference speed. If, however, the speed continues to increase the percent duty cycle likewise increases until a steady state condition is reached. The smoothing effect of the integrator will attempt to hold the system in a condition to maintain the engine speed at the governed value. If on the other hand, the engine experiences a sudden large acceleration, the second lead component from the circuit 36 becomes large and is effective to raise the control signal on line 22 to a value sufficient to operate the duty cycle oscillator and effect throttle closing to a degree dependent upon the amount of the acceleration. In this event the integrator 40 does not respond quickly enough to contribute significantly if at all to the control signal in the initial control phase. If the engine speed continues to increase in spite of the control efforts, the overspeed switch 42 will be triggered at its set point to produce a large output to quickly change the integrating capacitor 74 to force the duty cycle oscillator to 100% duty cycle and effect maximum throttle closing effort. The integrator output signal is applied to the base of the transistor 60 to turn on that transistor to ground the second lead component. As long as the overspeed condition exists, the maximum control signal is applied to the duty cycle oscillator. When, however, the engine speed decreases below the overspeed set level, the overspeed switch 42 turns off and the value of the control signal in line 22 is determined by the action of the integrator 40.

To further illustrate the circuit operation assume that for a truck a steady state desired governed speed is 4,000 RPM for a high load condition and 4,100 RPM for a no load condition. The resistor 68 is calibrated to set the integrator reference speed at 3,930 RPM. If engine speed slowly increases above that value, the integrator output starts increasing until a steady state is reached. At a high load condition the oscillator 20 will have an output of about 30% duty cycle, whereas at a low load condition, the steady state speed will be maintained with an oscillator output of about 70% duty cycle. The variable resistor 86 which controls the set point of the overspeed switch is set for a value slightly higher than the no load governed speed, say, 4,230 RPM. Thus the full throttle retarding effect is obtained if the engine speed reaches that value.

It will thus be seen that the control circuit according to this invention is easily and accurately calibrated by the adjustment of the two resistors 68 and 86 in the integrator circuit and the speed switch respectively to obtain predictable results in a minimum calibration time. It will be further seen that the control circuit provides for both low acceleration and high acceleration conditions by providing a strong lead term as well as an overspeed switch which are effective for control during high acceleration conditions and an integrator which controls maximum engine speed at low acceleration conditions and maintains steady state governing regardless of the acceleration history of the engine.

The embodiments of the invention in which an exclusive property or privilege is claimed are defined as follows:

1. In a system for limiting engine speed to near a governed value having means for limiting engine speed, a control circuit for actuating the limiting means comprising means for producing an electrical speed signal proportional to engine speed, a modifying circuit responsive to the speed signal for producing a control signal for energizing the limiting means as a function of engine speed, a duty cycle oscillator responsive to the control signal for producing a pulsed output having a duty cycle generally proportional to the control signal, the pulsed output energizing the limiting means, the modifying circuit including means for producing a first component of the control signal proportional to engine speed, derivative means for producing a lead component of the control signal proportional to engine acceleration, integrator means including a capacitor for producing an integrated component of the control signal comprising the integral of the excess of the engine speed over a governed speed, the integrated component when it attains a predetermined value being effective to raise the control signal to a sufficient value for maximum engine speed limiting, means responsive to the said integrated component for reducing the value of the lead component when the integrated component attains the said predetermined value, and speed switch means effective when engine speed reaches a preset limit speed above the governed speed for rapidly charging said capacitor of the integrator means to the said predetermined value of the integrated component to effect maximum engine speed limiting, the integrating action of the integrator means being predominant during gradual engine acceleration and lead component and the speed switch action being predominant during sudden acceleration, whereby the control circuit is conditioned to provide an energizing signal to the limiting means sufficient to limit engine speed near a governed value for both gradual and sudden engine acceleration.

* * * * *